United States Patent [19]

Iizuka et al.

[11] 4,178,868

[45] Dec. 18, 1979

[54] METHOD AND APPARATUS FOR DISPLACING OIL AND SEAWATER IN TANKS OF AN OIL TANK

[75] Inventors: Jinya Iizuka; Seinosuke Kato; Akio Matsuda, all of Osaka, Japan

[73] Assignee: Sumitomo Electric Industries Ltd., Osaka, Japan

[21] Appl. No.: 887,915

[22] Filed: Mar. 17, 1978

Related U.S. Application Data

[63] Continuation of Ser. No. 770,144, Feb. 18, 1977, abandoned.

[51] Int. Cl.[2] ..... B63B 25/12

[52] U.S. Cl. ..... 114/74 R; 220/85 B

[58] Field of Search ..... 114/74 R, 74 A, 74 T, 114/256, 257, 125; 220/85 B

[56] References Cited

U.S. PATENT DOCUMENTS

| | | | |
|---|---|---|---|
| 3,477,401 | 11/1969 | Hayama | 114/74 A |
| 3,922,985 | 12/1975 | Hamilton | 114/74 R |
| 3,943,873 | 3/1976 | Hering et al. | 114/74 R X |
| 4,007,700 | 2/1977 | Haynes et al. | 114/74 T |

FOREIGN PATENT DOCUMENTS

| | | | |
|---|---|---|---|
| 2109978 | 9/1972 | Fed. Rep. of Germany | 114/74 R |

*Primary Examiner*—Stephen G. Kunin
*Assistant Examiner*—Sherman D. Basinger
*Attorney, Agent, or Firm*—Sughrue, Rothwell, Mion, Zinn and Macpeak

[57] ABSTRACT

Each of compartments of an oil tanker is divided by a flexible membrane into first and second sections one of which is used as an oil chamber. The membrane is made of an oil-resistant and chemical-resistant material. When an oil is loaded, the second section is unloaded, the second section is filled with a ballasting seawater, crashing the first section.

6 Claims, 16 Drawing Figures

METHOD AND APPARATUS FOR DISPLACING OIL AND SEAWATER IN TANKS OF AN OIL TANK

This a continuation of application Ser. No. 770,144 filed Feb. 18, 1977, now abandoned.

BACKGROUND OF THE INVENTION

The present invention relates to a ballasting method for an oil tanker. An oil tanker is operated with a full load of oil on one way from a loading base to an unloading base at which the oil is refined and with a minimum load or without load on the returning way from the refining base to the loading base. It is well known that on the return voyage, the ship becomes top-heavy, leading to a danger of capsize. In order to overcome the above problem, it is common practice to "ballast" the ship by filling the tanks with seawater on the return way. However, when an oil tanker is ballasted with seawater, it is necessary to exhaust seawater from the tank before loading crude oil. Since exhausted seawater may contain some oil component, there is a possibility of seawater contamination causing a problem of pollution. Such activity is prohibited by various rules thereby preventing the discharge of ballasting water directly to sea. Therefore, in order to exhaust ballasting water, the ship must be moved to a particular base capable of processing the contaminated water and then to the oil loading base. If the tanker has been designed to have separate compartments for separate loading of crude oil and seawater the above problem may be eliminated. However, with such tanker design the amount of crude oil to be loaded will be greatly reduced.

In order to resolve these problems various designs of tanker compartments have been proposed. For example, Japanese Patent Public Disclosure No. 48-29184 discloses a tanker structure in which ballasting water and oil are separately introduced and discharged without reducing the amount of crude oil to be loaded by using a elastic partition wall of oil-resistant and chemically stable material for each compartment for partitioning into a ballast water section and an oil section. FIGS. 1 and 2 show the structure disclosed by the aforementioned prior art publication in which FIG. 1 is a cross sectional side view of a compartment of a tanker and FIG. 2 shows a cross sectional front view of the compartment in FIG. 1. The compartment 1 is defined by a deck plate 2, a bottom wall 3 and side walls 4 and 4', into which oil and ballasting seawater are introduced. A peripheral portion of a partition membrane 5 made of oil-resilient and chemically stable material is sealingly clamped by clamping members 6 provided along lines A–B, B–C, C–D and D–A as in FIG. 2, to divide the compartment 1 into two liquid tight sections a and b. In this construction, when oil is introduced via a proper inlet into the chamber a the partition membrane 5 is deformed toward the side wall 4, allowing oil to occupy a space of the chamber a. On the other hand, when ballasting seawater is to be introduced into the compartment, the partition membrane is deformed backwardly to the side wall 4' so that the chamber b is filled with seawater. In this manner, the compartment 1 can be filled alternatively with crude oil and ballasting water. However, since the current tankers are extremely large in size, both the compartment and partition membrane become correspondingly large.

For this reason, it has been found that when either chamber a or b is to be filled under a full or empty condition of the compartment 1 the partition membrane 5 is not deformed uniformly, causing high pressure to be locally applied on the membrane. It has been further found that even if it is deformed uniformly, a very large tensile force is applied to the membrane due to a pressure as high as 0.7–1.0 $Kg/cm^2$ per water level of 10 m.

For this reason the material strength of the membrane is high and expensive.

SUMMARY OF THE INVENTION

It is therefore an object of the present invention to overcome the above mentioned drawbacks inherent to the conventional method and to provide an improved method for displacing crude oil and seawater wherein the resilient partition membrane is employed to the ballasting system. Briefly, according to the present invention, a compartment is liquid-tightly divided by the membrane into two sections, one of which being filled with crude oil and the other of which being filled with seawater, i.e., the membrane is on one surface contacted with crude oil and of the opposite surface with seawater. By the employment of such a membrane, the displacement between crude oil and seawater can be smoothly performed.

DETAILED DESCRIPTION OF THE INVENTION

Figure 1:
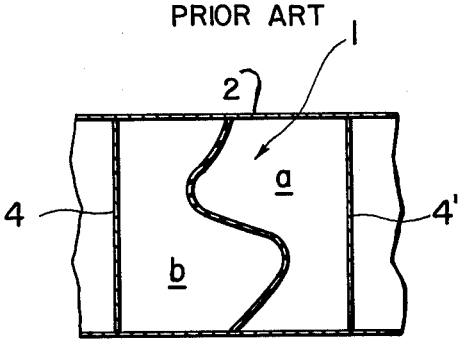
FIG. 1 PRIOR ART
FIG. 1 shows a simplified cross sectional side view of a prior art compartment of a tanker.
Figure 2:
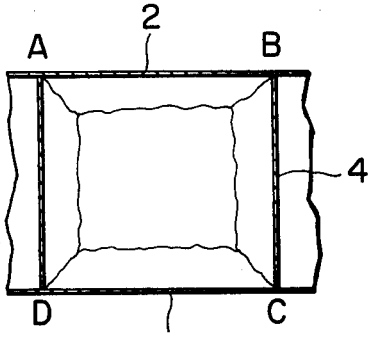
FIG. 2 PRIOR ART
FIG. 2 shows a simplified cross sectional front view of the compartment in FIG. 1.
Figure 3:
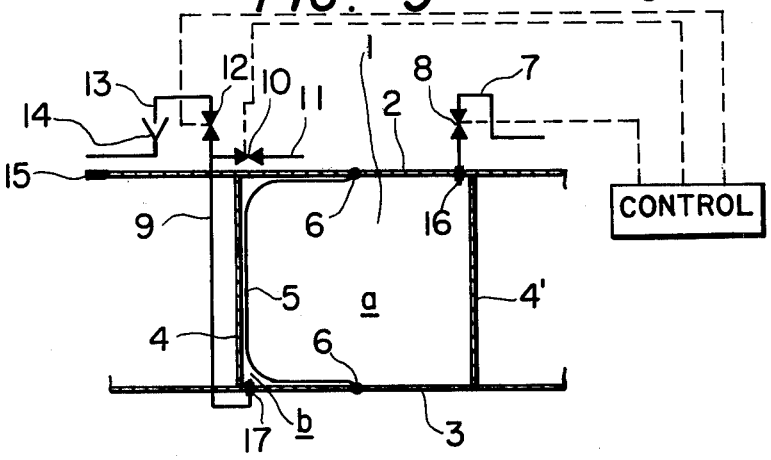
FIG. 3 shows a simplified cross sectional side view of a compartment of a tanker according to one embodiment of the present invention.

In FIG. 3, a compartment 1 is defined by a deck plate 2, a bottom wall 3 and side walls 4 and 4', into which oil and ballasting seawater are introduced. A peripheral portion of partition membrane 5 made of oil-resistant and chemically stable material is sealingly clamped by clamping members 6 provided along lines A–B, B–C, C–D and D–A as in FIG. 2, to liquid-tightly divide the compartment 1 into two sections a and b. The membrane is connected to the upper and lower surfaces of the compartment midway between the junctures of these surfaces and the compartment sidewalls. An intake and exhaust port 16 of the crude oil is provided at the upper portion of the compartment, i.e., at the deck plate 2. A pipe 7 is connected to the port 16 through a valve 8. On the other hand, an intake and exhaust port 17 of seawater is provided at the bottom portion of the compartment, i.e., at the bottom wall 3. A pipe 9 is connected to the port 17 through valves 10 and 12, both of which are positioned above the compartment 1.

Seawater is supplied into the compartment 1 by closing the valve 12 and opening the valves 10 and 8 with the pipe 11 connected to valve 10. Seawater is discharged from the compartment 1 by closing the valve 10 and opening the valve 12 to which a pipe 13 is connected. One end of the pipe 13 is opened to form a head to the atmosphere at the upper place of the compartment. A funnel 14 is disposed under the opening or head of the pipe 13 to receive the discharged seawater. The funnel 14 further connects to a pipe 15 from which seawater is discharged into the sea. As shown in FIG. 3, appropriate control means are used to open and/or close valves 8, 10, and 12 to discharge or charge sections a and b with oil or seawater respectively during loading and unloading operations.

Next, a method will be described hereinafter in which seawater supply into the compartment 1 and crude oil discharge therefrom are simultaneously achieved.

Figure 4A:
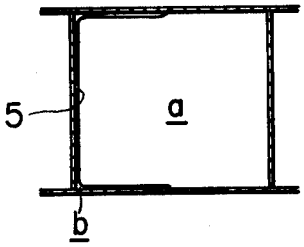
FIGS. 4A to 4E show the processes of displacing seawater and crude oil.
Figure 4B:
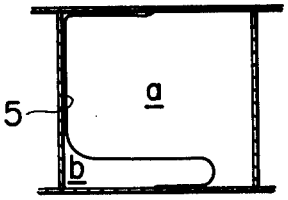
Figure 4C:
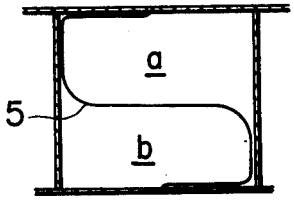
Figure 4D:
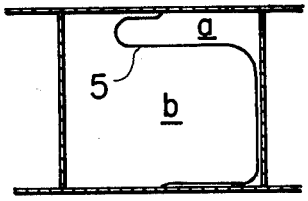
Figure 4E:
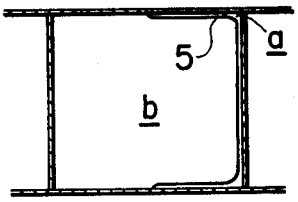

In FIG. 4(A), crude oil is filled in a section a of the compartment 1. In FIG. 4(B), the valves 10 and 8 are opened to supply seawater into the section b through the pipes 11 and 9, so that crude oil in the section a is discharged therefrom through the pipe 7. Since the specific gravity of seawater is larger than that of crude oil, seawater supplied into the section b is accumulated at the bottom thereof to move the partition membrane 5 upwardly so that crude oil in the section a is discharged through the opening valve 7. In FIG. 4(D), seawater occupies almost all the space in the compartment. In FIG. 4(E), seawater is filled in the compartment and crude oil discharge is completed. In this state, the membrane 5 is positioned on the side opposite to that in FIG. 4(A), in which crude oil is still present in the space between the sidewall 4' and the membrane 5 and in the pipe 7. Thereafter, the valves 10 and 8 are closed, while the valve 12 is opened to discharge the amount of seawater which exceeds the head of the pipe 13 due to the change of volume of seawater in the section b depending on the thermal expansion thereof. In this manner, crude oil is replaced by seawater and the tanker is ready to travel to the next port for loading crude oil.

Conversely, a method will be described hereinafter in which crude oil supply into the compartment and seawater discharge therefrom are made simultaneously.

Crude oil loading process starts from the state shown in FIG. 4(E) and is complete in the state shown in FIG. 4(A). In FIG. 4(E), seawater is filled in the section a. In FIG. 4(D), the valves 12 and 8 are opened to supply crude oil into the section a through the pipe 7 and to discharge seawater through the pipes 9 and 13. Since the specific gravity of crude oil is smaller than that of seawater, crude oil supplied into section a is accumulated at the upper portion of the compartment 1 to move the membrane 5 downwardly to thereby discharge seawater from the port 17 and from the head of the pipe 13. In FIG. 4(C), the crude oil and seawater are approximately equal, and in FIG. 4(B), crude oil occupies almost all the space of the compartment 1. In FIG. 4(A) crude oil fills the compartment and seawater discharge is complete. In this state, seawater still remains in the pipe 13 up to the head thereof. In this state, the excessive amount of crude oil due to thermal expansion can be discharged, providing oil head at the pipe 7. In doing so, the valve 8 is opened to communicate oil through the section a with the pipe 7, while the valve 12 is closed. In all of the cases, according to the present invention, oil and seawater always fills the spaces defined between the membrane 5 and the compartment 1.

Another embodiment according to the present invention will be described hereinafter.

Figure 5:
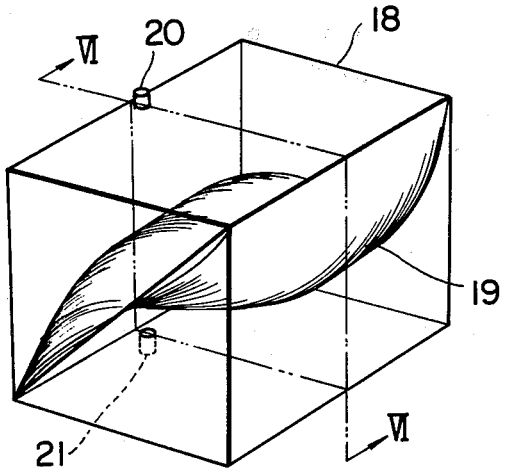
FIG. 5 shows a perspective view of another embodiment according to the present invention.

In FIG. 5, a partition membrane 19 is provided obliquely in a compartment 18, in which the membrane 19 is sealingly clamped to diagonal points of the compartment. The membrane is connected to the junctures between the top surface of the compartment and a side wall and the bottom surface of the compartment and the opposite side wall.

Figure 6:
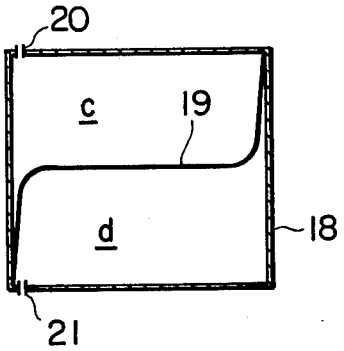
FIG. 6 shows a simplified vertical cross-sectional view in FIG. 5 taken along the flat plane VI.
Figure 7A:
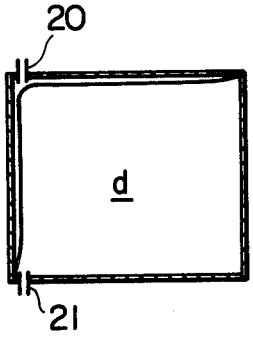
FIGS. 7A to 7F show the processes of displacing seawater and crude oil.
Figure 7B:
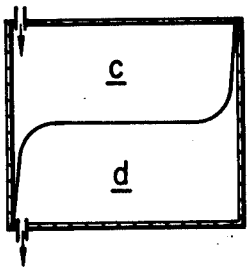
Figure 7C:
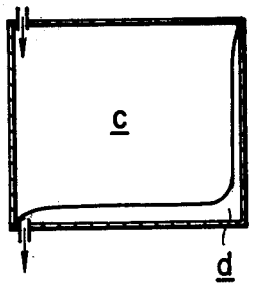
Figure 7D:
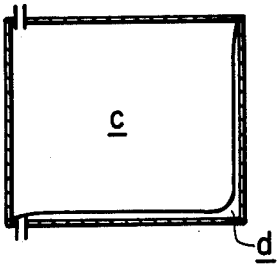

In FIG. 6, the compartment 18 is divided into two liquid tight sections c and d by a partition membrane 19. Reference numerals 20 and 21 designate an oil intake and discharge port and ballasting seawater intake and discharge port, respectively. In FIG. 7(A), seawater is filled in the section d whose volume is almost equal to that of the compartment 18. In FIG. 7(B), oil is introduced into the section c through the port 20, and simultaneously seawater in the section d is discharged through the port 21. In FIG. 7(D), oil is filled in the section c whose volume is almost equal to that of the compartment 18, upon which seawater discharge is complete.

Figure 7E:
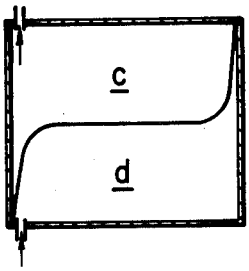
Figure 7F:
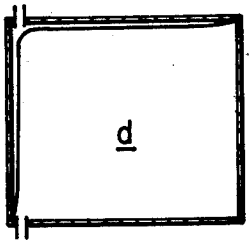

Conversely in FIG. 7(E), seawater is introduced into the section d through the port 21, simultaneously oil in the section c is discharged through the port 20. In FIG. 7(F), seawater is filled with the section d whose volume is almost equal to that of the compartment 18, upon which oil discharge is complete.

What is claimed is:

1. An apparatus for displacing oil and seawater in an oil tanker having a plurality of sealed compartments, each having a deck plate, side walls and bottom plate, comprising:

(a) a single partition membrane made of oil-resistant and chemically stable flexible material clamped to the compartment in a liquid seal arrangement, said membrane dividing the compartment into a first section adapted to be filled with oil and a second section adapted to be filled with seawater, said membrane configured to contact opposite sides of said compartment, said membrane being connected at one end to the upper surface of the compartment and at the opposite end to the lower surface of said compartment, the surface area of one side of said membrane being substantially one-half the inner surface area of said compartment, (b) a first port means connected to the first section at an upper portion of said compartment, (c) a second port means connected to the second section at a lower portion of said compartment, (d) a first valve means adapted to connect said first port means to oil, (e) a second valve means adapted to connect said second port means to seawater, and (f) means for controlling said first and second valve means to discharge said first section while charging said second section wherein said compartment is maintained in a full condition.

2. The apparatus of claim 1 wherein said ends of said membrane are connected to said upper and lower surfaces along lines parallel to the junctures between the upper and lower surfaces and side walls and substantially midway between the side walls.

3. The apparatus of claim 1 wherein said first mentioned end of said membrane is connected to said upper surface at a juncture between said upper surface and a first side wall and said second mentioned end is connected to said lower surface at a juncture between said lower surface and the sidewall opposite said first side wall.

4. In a method for displacing oil and seawater in an oil tanker, said tanker having a plurality of sealed compartments having therein a single flexible membrane configured to contact opposite sides of said compartment, said membrane dividing said compartment into a first section adapted to be filled with oil and a second section adapted to be filled with seawater, and valve means for the supply and discharge of oil through first port means at upper portions of said compartments, valve means for the supply and discharge of seawater through second port means at lower portions of said compartments, comprising the steps of: supplying oil through first port means at an upper portion of said compartment while simultaneously discharging water through second port means at a lower portion of said compartment and then supplying water through said second port means at a lower portion of said compartment while discharging oil through said first port means at said upper portion of said compartment to maintain said compartment in a full condition wherein, when filled with oil said membrane will contact one wall of said compartment and when said compartment is filled with seawater said membrane will contact an opposite wall of said compartment, said membrane being connected at one end to the upper surface of the compartment and at the opposite end to the lower surface of said compartment, the surface area of one side of said membrane being substantially one-half the inner surface area of said compartment.

5. The method of claim 4 wherein said ends of said membrane are connected to said upper and lower surfaces along lines parallel to the junctures between the upper and lower surfaces and side walls and substantially midway between the side walls.

6. The method of claim 4 wherein said first mentioned end of said membrane is connected to said upper surface at a juncture between said upper surface and a first side wall and said second mentioned end is connected to said lower surface at a juncture between said lower surface and the side wall opposite said first side wall.

* * * * *